United States Patent [19]

Steffen

[11] 4,311,218

[45] Jan. 19, 1982

[54] BRAKING DEVICE FOR USE WITH CLIMBING LINES

[76] Inventor: Lisle J. Steffen, 11920 SW. 158th, Portland, Oreg. 97236

[21] Appl. No.: 126,578

[22] Filed: Mar. 3, 1980

Related U.S. Application Data

[63] Continuation-in-part of Ser. No. 16,413, Mar. 1, 1979, abandoned.

[51] Int. Cl.[3] ..... B65H 59/14; A62B 1/16

[52] U.S. Cl. ..... 188/65.4; 182/5

[58] Field of Search ..... 188/65.4, 65.5, 65.3, 188/65.2; 182/5-7, 191-193, 71-72, 100; 24/115 G, 136 R, 136 K, 171, 194, 196

[56] References Cited

U.S. PATENT DOCUMENTS

| | | | |
|---|---|---|---|
| 194,507 | 8/1877 | Wie | 188/65.4 |
| 285,603 | 9/1883 | Fell | 188/65.3 |
| 3,217,840 | 11/1965 | Holkesvick | 188/65.4 |
| 3,260,328 | 7/1966 | McGowan | 188/65.4 X |
| 4,019,609 | 4/1977 | Wagner | 188/65.4 |
| 4,114,726 | 9/1978 | Sentinella | 188/65.5 X |

*Primary Examiner*—John M. Jillions

*Attorney, Agent, or Firm*—Chernoff & Vilhauer

[57] ABSTRACT

A braking device for controlling the slippage of a line therethrough comprises an elongate flat link having a load-carrying eye at each end thereof. A plurality of crossbars connecting longitudinal side members of the link are spaced apart along one side of the link, while swinging brake bars are pivotably connected to one of the longitudinal members of the link, interposed between adjacent crossbars. One end of each swinging brake bar is free to be pivoted away from the other of the longitudinal members, permitting a bight of a line to be passed around each brake bar, providing a serpentine path for the line through the braking device. Applying tension to a free end of the line controls the frictional braking effect of the device as the line is pulled through the braking device by a suspended load.

6 Claims, 8 Drawing Figures

BRAKING DEVICE FOR USE WITH CLIMBING LINES

REFERENCE TO PRIOR APPLICATION

This application is a continuation-in-part of copending patent application Ser. No. 016,413 filed Mar. 1, 1979, now abandoned.

BACKGROUND OF THE INVENTION

The present invention relates to mountain climbing apparatus, and in particular to a braking device for use with a climbing line during rapelling and in rescue operations.

In mountain climbing and similar situations it often becomes necessary to support oneself or a load on a line made fast to a rock, tree, or other point of attachment, as a person or other load is lowered by allowing controlled slippage of the line. In lowering oneself, for example by rapelling, controlled slippage of a line has been accomplished by wrapping the line around a portion of the climber's body. Increased controllability of a line during rapelling can be accomplished by also passing the line through a carabiner equipped with a brake bar. Further control has been gained by using two carabiners equipped with brake bars and interconnected by a third carabiner. This, however, has been found by some to be an awkward arrangement which is likely to twist, causing tangling of lines and reducing efficiency below that which is desired. A particular problem with the use of carabiners is that any lines secured to a carabiner may interfere with a line being slipped through the carabiner, making control of slippage uncertain.

The construction of previously known brake bars intended for use with carabiners has required that the end of a line be passed through the carabiner, around the brake bar and again through the carabiner, with the carabiner and brake bar combination thereafter being slid along a line to the desired location. As a result, an undesirable amount of time is consumed in preparing such apparatus for rapelling. Since time may be critical during a rescue operation where personnel or equipment must be passed down to an injured or otherwise stranded climber, it is important to be able to rig lines quickly for controlled lowering of personnel and equipment. Particularly in rescue operations, the need may arise for lowering unusually heavy loads quickly. In such a situation, a carabiner, because of its interrupted loop construction, may be too weak.

Lines frequently become wet, muddy, and slippery during climbing. As a result of such conditions, a carabiner and brake bar, or even two interconnected carabiners equipped with brake bars, may provide insufficient braking force to control the lowering of heavy loads.

To meet these problems, braking devices such as those disclosed in Hobbs U.S. Pat. Nos. 3,678,543, 3,695,397, and 3,757,901, have been developed. Other line-controlling devices intended primarily to permit people to lower themselves, are disclosed in Van Wie U.S. Pat. No. 194,507, Fell U.S. Pat. No. 285,603, McGowan U.S. Pat. No. 3,260,328, and Sentinella U.S. Pat. No. 4,114,726. The devices disclosed in these patents have been, however, unnecessarily cumbersome, heavy, or complex for use in mountain climbing and rescue work, and are therefore not completely satisfactory for such use.

What is needed, therefore, is a device which may be quickly and easily attached to a mountain climber's or rescuer's line, to securely and reliably control slippage of the line during lowering of personnel and equipment. Preferably such a device should be usable either in rapelling or in controlled lowering of objects from above a stranded climber, and should be resistant to tangling and twisting of lines which could produce loss of control.

SUMMARY OF THE INVENTION

The present invention overcomes the aforementioned shortcomings and drawbacks of previously-known apparatus and methods for controlling descent along a line, by providing an improved braking device for use with climbing lines. The braking device of the present invention comprises an elongate link including an attachment point for a load-carrying line at each of its ends, and having a plurality of fixed crossbars and at least one brake bar which is pivotably connected to the link in a manner permitting attachment of the braking device to a climbing line at any point along the length of the line.

In a preferred embodiment of the braking device of the present invention, an elongate link has a pair of parallel longitudinal members and four fixed crossbars which act as stationary brake bars. The fixed crossbars are attached to the link parallel to one another, all on the same side of the link, extending across the two longitudinal members of the link. Three swinging brake bars are all pivotably attached to one of the longitudinal members, interposed between adjacent ones of the crossbars. One end of each brake bar is free to swing away from the side of the link opposite the crossbars, to allow a bight of a climbing line to be slipped through the link between a pair of crossbars and placed around the free end of the brake bar. Provision is made for the brake bar to fit against the link in a position parallel with the crossbar, thus providing a serpentine course of the line through the braking device of the invention.

It is a primary objective of the present invention to provide an improved and more efficient braking device for use with climbing lines, and particularly adapted for use in rescue operations.

It is another important objective of the present invention to provide a braking device for use with climbing lines which is readily attachable to a line.

It is a further objective of the present invention to provide a compact and light braking device which has greater strength for supporting loads than previously-known braking devices.

It is yet a further objective of the present invention to provide a braking device including an attachment point for securing an end of a line on each end of the device.

It is a primary feature of the braking device of the present invention that it includes a brake bar which is pivotably attached to one side of an elongate load-carrying link, while the other end of the brake bar is freely movable to allow a loop of a climbing line to be placed around the brake bar, allowing the braking device to be attached to a climbing line at any point along the line.

It is another feature of the braking device of the present invention that a plurality of brake bars are interposed between crossbars located on an elongate load-carrying link, providing a serpentine path for a climbing line which permits controlled braking of the line as it passes through the device.

It is an important advantage of the present invention that it provides a braking device which is highly efficient in controlling slippage of a line therethrough, even when the line is muddy or wet.

It is another important advantage of the present invention that it provides better control of slippage than is attainable using previously-known apparatus, yet is no more cumbersome than carabiners which are normally a part of each climber's gear.

It is a further advantage of the present invention that it provides a braking device which need not be attached by threading the end of a line therethrough, but permits rapid attachment at any point along a climbing line.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
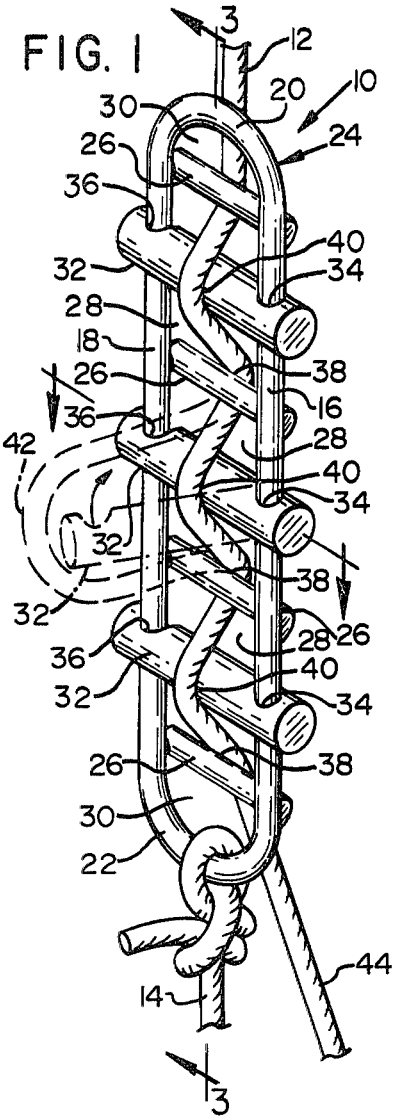
FIG. 1 is a pictorial view of an exemplary braking device embodying the present invention, showing the manner of reeving a line therethrough.

Referring to FIGS. 1–5 of the drawings, a brake device 10 embodying the present invention may be seen with a line 12 engaged therein in a serpentine fashion. A load-carrying line 14 is made fast to the device 10, which has a pair of parallel longitudinal members 16 and 18 connected to one another at each end by curved end portions 20 and 22, all being, for example, of round stainless steel bar stock in the overall shape of a flat, rigid, elongate link 24. While other materials may be used, stainless steel, because of its strength in relation to size, and because of its good thermal conductivity, is the preferred material for the device.

A plurality of stationary crossbars 26, of similar material, which act as stationary brake bars, are fixedly attached, for example by welding, to the link 24. The crossbars 26 extend generally transversely across the link 24 at regularly-spaced locations defining a plurality of spaces 28 between adjacent ones of the crossbars 26. In the preferred embodiment depicted in FIGS. 1–5 the crossbars 26 lie across the longitudinal members 14 and 16 in a separate plane on one side of the link 24, rather than extending between the longitudinal members 14 and 16 entirely within the load-carrying link 24. This location provides additional braking capability as will be appreciated upon reading the entire description of the preferred embodiment. A load-carrying eye 30 is defined at each end of the load-carrying line 24, between one of the crossbars 26 and the respective end portion 20 or 22.

A swinging brake bar 32 is pivotably attached to the longitudinal member 16 in each space 28 between a pair of adjacent crossbars 26. Each brake bar 32 is preferably of round stainless steel bar stock of about twice the diameter of that used for the link 24 and crossbars 26, and may be attached to the longitudinal member 16 by provision of a drilled hole 34 extending through the brake bar 32. A notch 36 defined in each brake bar 32 permits the brake bar 32 to assume a position generally parallel to the plane of the link 24 and the crossbars 26, and also permits the brake bar to swing away from the longitudinal member 18, on the side of the link 24 opposite the crossbars 26, to an open position permitting installation of the braking device 10 on a line 12.

When the line 12 is arranged as shown in solid line in FIGS. 1–4, the line 12 rests in contact with braking surfaces 38 and 40 respectively on the crossbars 26 and the swinging brake bars 32, which provide frictional resistance to slippage of the line 12 through the braking device 10 of the present invention. Such frictional resistance to slippage is, of course, proportional to the total area of braking surfaces 38 and 40, as well as to the force exerted against those surfaces by the line 12.

Figure 6:
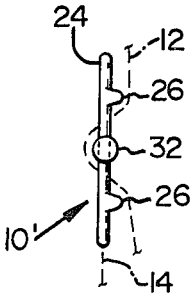
FIG. 6 is an edge view, at a reduced scale, of a braking device which is an alternative embodiment of the present invention.
Figure 7:
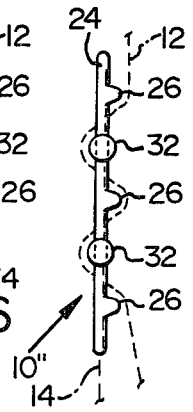
FIG. 7 is an edge view, at a reduced scale, of a braking device which is a second alternative embodiment of the present invention.
Figure 8:
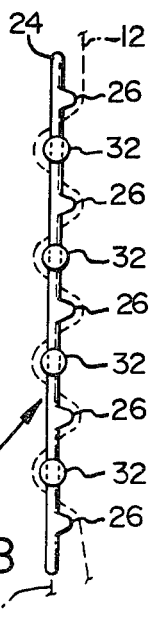
FIG. 8 is an edge view, at a reduced scale, of a braking device which is yet a third alternative embodiment of the present invention.

While the braking device 10 shown in FIGS. 1–5 is equipped with four crossbars 26 and three swinging brake bars 32, alternative embodiments of the invention are possible. For example, as shown in FIG. 6, a brake device 10′ has only one swinging brake bar 32 and two crossbars 26. Similarly, a braking device 10″ shown in FIG. 7 has three crossbars 26 and two brake bars 32, and a braking device 10‴ shown in FIG. 8 has five crossbars 26 and four brake bars 32. In each case, where there is a greater number of crossbars and swinging brake bars, the device is capable of holding a greater load under otherwise similar conditions, since there is a proportionately greater total frictional surface area.

Figure 2:
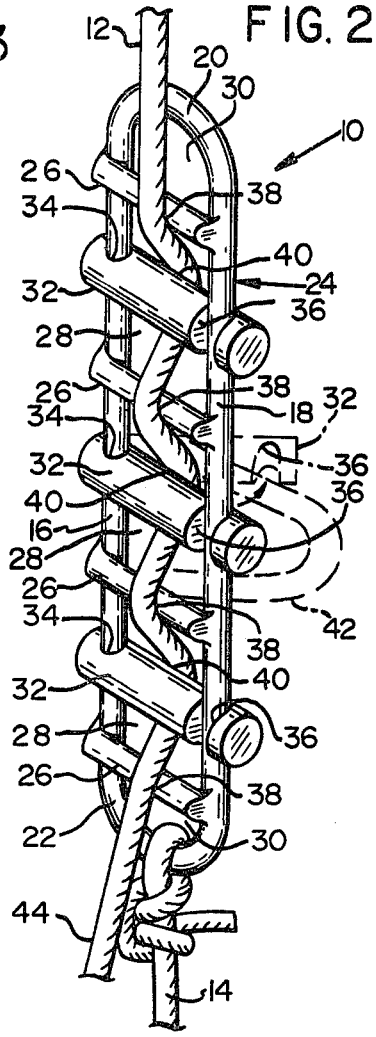
FIG. 2 is a pictorial view of the braking device shown in FIG. 1 as seen from the opposite side of the device.
Figure 4:
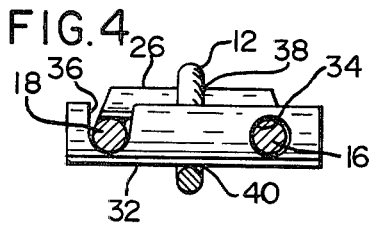
FIG. 4 is a sectional end view of the braking device shown in FIG. 1, taken along line 4—4 of FIG. 1.
Figure 5:
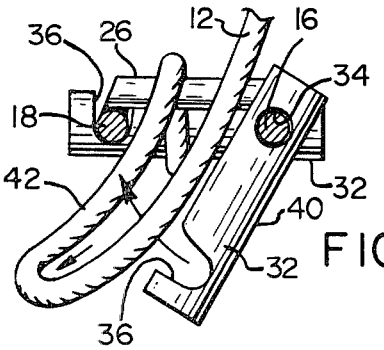
FIG. 5 is a sectional end view of the braking device shown in FIG. 1, showing the manner of attaching the braking device to a climbing line.

The braking device 10 of the invention may be attached to the line 12 as shown in FIG. 5, and as shown in broken line in FIGS. 1 and 2, by passing a bight 42 of the line through the space 28 between two adjacent crossbars 26, with the respective swinging brake bar 32 pivoted away from the longitudinal member 18. The bight of line 42 is slipped over the free end of the swinging brake bar 32, which is then pivoted back to its position parallel to the crossbars 26, with the longitudinal member 18 fitting within the notch 36 in the swinging brake bar 32. The process is repeated with each of the swinging brake bars 32 of the braking device, resulting in the line assuming a serpentine path through the braking device 10. Tension in the line, resulting from fixed attachment of one end of the line to a stationary object and manual control of the other end of the line as it slides through the device 10, thereafter holds the line tightly against the braking surfaces 38 and 40, simultaneously holding the swinging brake bars 32 in their position with the notches 36 against the longitudinal member 18.

Figure 3:
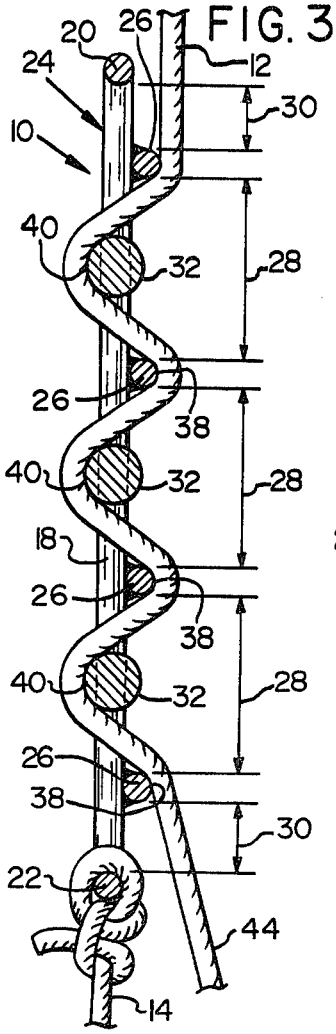
FIG. 3 is a sectional edge view of the braking device shown in FIG. 1, taken along 3—3 of FIG. 1.

It should be noted that the load-carrying eyes 30 are located in a plane spaced apart from the crossbars 16, as may be seen best in FIG. 3. The load-carrying line 12 and the free end 44 of the load-carrying line, passing around the outermost crossbar 26, are thus separated from the load-supporting line by at least the thickness of the crossbars 26. This helps to prevent tangling of load-supporting lines and the free portion 44 of a line used to control the amount of friction provided by the braking device 10.

As may be seen in FIGS. 1 through 3, the load-carrying line 14 is fastened into the load-carrying eye 30 formed by one of the crossbars 26 and the end portion 22 of the load-carrying link 24. The load-carrying line 14 may, for instance, be fastened to a suspension harness (not shown) to support a climber as he descends along the line 12, whose upper end (not shown) may be secured to a suspension point above. Tension applied by the climber to the free lower part 44 of the line 12, below the braking device 10, controls the amount of braking force applied to the line. As a result, a small amount of tension applied to the lower portion 44 of the line 12 produces a relatively large frictional force to slow or stop the descent of the climber suspended on the line 14 attached to the device 10. For example, the tension required to be applied to the free portion 44 to hold the braking device stationary on the line 12 may be as little as 1/40 of the load suspended on line 14.

The braking device may be used in a similar fashion for rapelling, in which case the line 12 may be passed through a carabiner (not shown) with both ends extending downward and one end being fastened into the load-carrying eye 30 at the upper end of the braking device.

In rescue operations, where equipment or personnel are being lowered by rescuing personnel located above a stranded or injured climber, the two load-carrying eyes 30 may similarly be used in an inverted arrangement, with the braking device secured to an attachment point by a line fastened into one of the load-carrying eyes 30, while the load-supporting line passes downwardly through the braking device 10, with the free portion of the line, corresponding to the free portion 44 of the line 12, extending upward, away from the load which is being lowered, allowing the rescuing personnel to control the rate of descent of the load from above.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A braking device for frictionally controlling passage of a flexible line therethrough during mountain climbing and rescue operations, comprising:

(a) an elongate link having a pair of generally parallel apart-spaced longitudinal members and a pair of opposite end portions interconnecting said longitudinal members;

(b) a plurality of apart-spaced crossbars, each of said plurality of crossbars extending between said longitudinal members at locations spaced apart from said opposite end portions, each of said plurality of crossbars extending across said longitudinal members on a first side of said elongate link; and (c) at least one elongate brake bar pivotably attached at a first end thereof to a first one of said pair of longitudinal members and extending across said longitudinal members in a location between adjacent ones of said crossbars, a second end of said at least one elongate brake bar resting against a second one of said pair of longitudinal members on a second side of said link when said braking device is installed on said line, said crossbars and said at least one brake bar defining a serpentine path for said line.

2. The braking device of claim 1 wherein each of said at least one elongate brake bar defines notch means for receiving said second one of said pair of longitudinal members, said notch means permitting each of said at least one elongate brake bar to be pivoted away from said second one of said longitudinal members.

3. The braking device of claim 2 wherein said link and said crossbars are of round bar material of a first diameter and each of said elongate brake bars is of material of a larger diameter, said first end of each of said elongate brake bars including a hole defined therein, said first one of said longitudinal members extending therethrough.

4. The braking device of claim 3 wherein each of said elongate brake bars is of a diameter about twice that of each of said crossbars.

5. A braking device for frictionally controlling passage of a flexible line therethrough during mountain climbing and rescue operations, comprising:

(a) an elongate link having a pair of generally parallel apart-spaced longitudinal members and a pair of opposite end portions interconnecting said longitudinal members;

(b) at least three apart-spaced crossbars extending between said longitudinal members on a first side of said link at locations spaced apart from said opposite end portions; and (c) a plurality of elongate brake bars one fewer than the number of said crossbars, each of said elongate brake bars being pivotably attached at a first end thereof to a first one of said pair of longitudinal members and extending across said longitudinal members in a location between adjacent ones of said crossbars, a second end of each of said elongate brake bars resting against a second side of said link, said crossbars and said plurality of brake bars being arranged to define a serpentine path for said line when said braking device is installed on said line.

6. A braking device for frictionally controlling the passage of a flexible line therethrough during mountain climbing and rescue operations, comprising:

(a) a unitary elongate, rigid, flat link having a pair of parallel apart-spaced longitudinal members and opposite end portions interconnecting said longitudinal members and defining attachment points for connection of a load-carrying line and the like thereto;

(b) at least three crossbars spaced apart from said opposite end portions, each of said crossbars being fixedly attached to both of said longitudinal members, and extending generally perpendicularly thereto, said crossbars being located on a first side of said link and defining a plurality of spaces between adjacent ones of said crossbars, and all of said crossbars defining a plane spaced apart from said opposite end portions;

(c) a plurality of brake bars one fewer than the number of said crossbars, each of said brake bars being of greater diameter than each of said longitudinal members, one end of one of said brake bars being pivotably attached to a first one of said pair of longitudinal members in each of said spaces between adjacent crossbars, a second end of each of said brake bars defining notch means for permitting said brake bars to pivot between a position in which said second end is clear of said link, permitting a bight of said line placed through said space from said first side of said link to be loopingly placed around said second end of said brake bar, and a position in which said second end of said brake bar is in contact with the second one of said pair of longitudinal members with said notch means surrounding a portion of said second longitudinal member on a second side of said link.

* * * * *